US010267148B1

(12) United States Patent
Ravencroft et al.

(10) Patent No.: US 10,267,148 B1
(45) Date of Patent: Apr. 23, 2019

(54) SELF-DRAINING ROCK ANCHOR

(71) Applicant: Nevada Industrial LLC, Sparks, NV (US)

(72) Inventors: Chris Ravencroft, Reno, NV (US); Dwight Peabody, Craig, AK (US)

(73) Assignee: Nevada Industrial LLC, Sparks, NV (US)

( * ) Notice: Subject to any disclaimer, the term of this patent is extended or adjusted under 35 U.S.C. 154(b) by 0 days.

(21) Appl. No.: 15/920,403

(22) Filed: Mar. 13, 2018

Related U.S. Application Data

(60) Provisional application No. 62/614,050, filed on Jan. 5, 2018.

(51) Int. Cl.
*E21D 21/00* (2006.01)
*E21D 20/00* (2006.01)

(52) U.S. Cl.
CPC ..... *E21D 21/0073* (2016.01); *E21D 20/00* (2013.01); *E21D 21/0013* (2013.01)

(58) Field of Classification Search
CPC combination set(s) only.
See application file for complete search history.

(56) References Cited

U.S. PATENT DOCUMENTS 4,423,986 A * 1/1984 Skogberg ..... E21D 20/00 405/259.1
2007/0217869 A1* 9/2007 Dawe ..... E21D 21/004 405/259.4
2013/0236251 A1* 9/2013 Smith ..... E21D 20/026 405/259.5

* cited by examiner

*Primary Examiner* — Kyle Armstrong
(74) *Attorney, Agent, or Firm* — Brownstein Hyatt Farber Schreck, LLP

(57) ABSTRACT

Rock anchors, such as those described herein, allow for substantially complete draining of fluids from interior volumes of the rock anchors. In various situations, corrosive fluids may be introduced to the rock anchor, including inflating the rock anchors and during normal use, such as by groundwater intrusion. The rock anchors described herein include multiple passages for more effectively draining fluid from the rock anchors during inflation processes and during general use.

18 Claims, 15 Drawing Sheets

SELF-DRAINING ROCK ANCHOR

CROSS-REFERENCE TO RELATED APPLICATION

This application is a non-provisional patent application of and claims the benefit to U.S. Provisional Patent Application No. 62/614,050, filed Jan. 5, 2018 and titled "Self-Draining Rock Anchor," the disclosure of which is hereby incorporated herein by reference in its entirety.

FIELD

Embodiments described herein relate to rock anchors, and in particular, to expandable rock anchors that include multiple passages for draining fluid from the rock anchors.

BACKGROUND

Underground mining is widely used to excavate minerals and other materials from beneath the earth's surface. Underground mining is often performed in harsh environments, and mining equipment is regularly subjected to damaging conditions, including corrosive substances. The effects of these corrosive substances are particularly acute for equipment that is embedded in a mining application, since this type of equipment is often exposed to the harsh environment and unavailable for cleaning or inspection for extended periods of time. Furthermore, embedded mining equipment often provides structural support for a mine, so avoiding failure of this type of equipment is a priority.

SUMMARY

Certain embodiments described herein relate to, include, or take the form of a self-draining rock anchor that includes an elongate anchor body and a bushing. The elongate anchor body is configured to be at least partially disposed in a cavity that extends from a surface of a rock structure into the rock structure. The elongate anchor body comprises a sidewall that extends along a length of the elongate anchor body. The sidewall defines first and second openings that extend through the sidewall. The bushing is disposed around the elongate anchor body and configured to interface with a washer disposed around the elongate anchor body. The bushing defines third and fourth openings that substantially align with the first and second openings in the elongate anchor body, respectively. The first and third openings form a first passage into an interior volume of the elongate anchor body, and the second and fourth openings form a second passage into the interior volume of the elongate anchor body. Further, the elongate anchor body has a first diameter in a first configuration. The interior volume of the elongate anchor body is configured to receive an inflation agent via at the least one of the first or second passages, thereby causing the elongate anchor body to expand to a second expanded configuration in which the elongate anchor body has a second diameter greater than the first diameter. In the second expanded configuration, an exterior surface of the sidewall of the elongate anchor body is configured to engage with an interior surface of the cavity, thereby retaining the elongate anchor body in the cavity. Further, the bushing is configured to exert a force on the washer, thereby causing the washer to exert a corresponding force on the surface of the rock structure. Additionally, the first and second passages facilitate substantially complete draining of the interior volume.

Other embodiments described generally reference a rock anchor comprising an anchor body and a bushing. The anchor body defines an interior volume and comprises a first sealed end and a second sealed end. The bushing is fixedly disposed around a portion of the anchor body and defines an exterior surface. The bushing is configured to be disposed at least partially within an inflation device in an inflation configuration. The inflation device defines an opening and comprises an inflation ring that is configured to encircle the bushing in the inflation configuration. The anchor body and the bushing define first and second substantially cylindrical passages extending from the exterior surface of the bushing into the interior volume of the anchor body. In the inflation configuration, at least one of the first or second substantially cylindrical passages is configured to align with the inflation ring, and the interior volume of the anchor body is configured to receive an inflation agent from the inflation ring via the at least one of the first or second substantially cylindrical passages, thereby causing the anchor body to expand from a first shape having a first diameter to a second shape having a second diameter greater than the first diameter. In a draining configuration, the first and second substantially cylindrical passages fluidly couple the interior volume to an ambient environment to drain substantially all fluid from the interior volume via the first and second passages, and the anchor body maintains the second shape.

Still other embodiments described generally reference a method for expanding and draining an expandable rock anchor that includes the steps of inserting, at least partially into a borehole, a rock anchor having a first shape having a first diameter that is less than a diameter of the borehole, the rock anchor defining first and second openings to an interior volume of the rock anchor. The steps further include substantially filling the interior volume with fluid using at least one of the first or second openings, thereby causing the rock anchor to expand to a second shape having a second diameter that is greater than the first diameter and substantially equal to the diameter of the borehole. The steps further include draining substantially all of the fluid from the interior volume using the first and second openings. In addition, the rock anchor maintains the second shape following the draining of substantially all of the fluid from the interior volume, and an exterior surface of the expanded rock anchor engages with an interior surface of the borehole, thereby retaining the rock anchor in the borehole.

BRIEF DESCRIPTION OF THE DRAWINGS

Reference will now be made to representative embodiments illustrated in the accompanying figures. It should be understood that the following descriptions are not intended to limit this disclosure to one preferred embodiment. To the contrary, the disclosure provided herein is intended to cover alternatives, modifications, and equivalents as may be included within the spirit and scope of the described embodiments, and as defined by the appended claims.

The use of the same or similar reference numerals in different figures indicates similar, related, or identical items.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the claims.

Rock excavations, including underground tunnels and other passageways common in mining and other subterranean activities can collapse. A collapse may harm people in and round the excavation and cause damage to equipment. As a result, techniques are required to support the rock excavations. Support structures can be inserted into ceilings and walls to strengthen them. For example, a tube-like structure may be inserted into a hole in the ceiling or wall and subsequently be expanded within the hole to add internal structural strength.

Figure 1A:
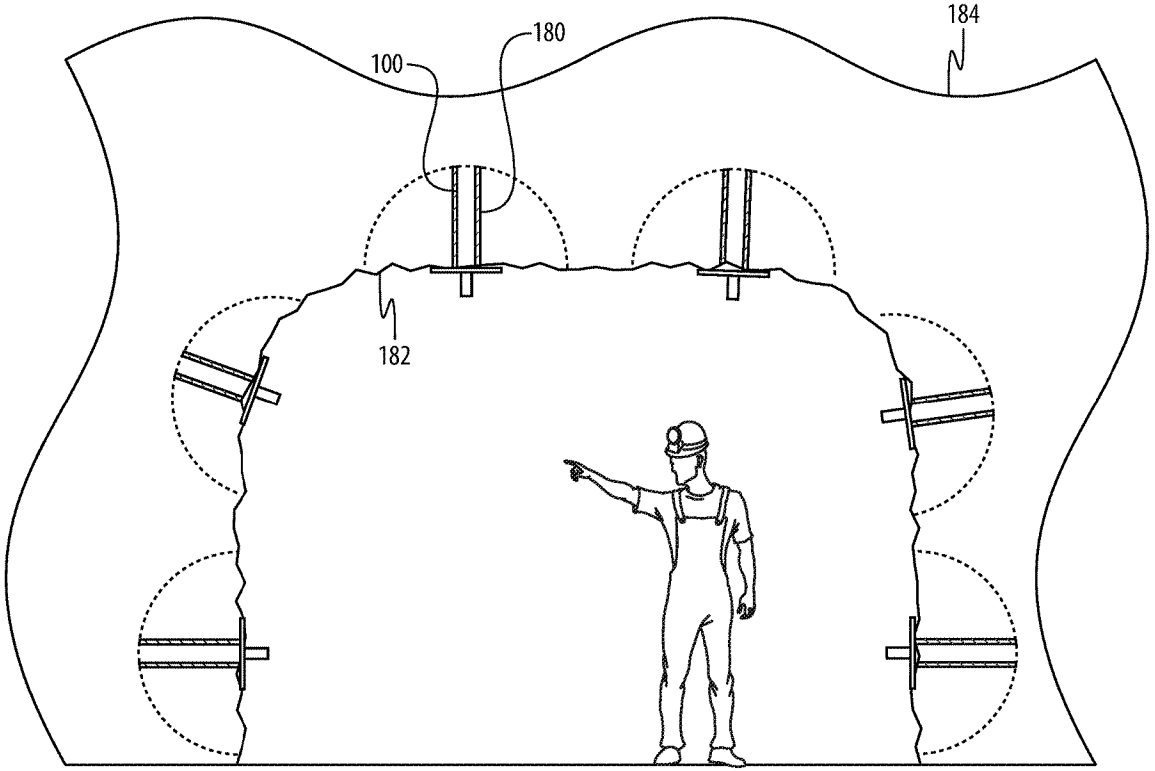
FIG. 1A illustrates a cutaway view of several rock anchors 100 in use in an underground mining environment.

Rock anchors (e.g., rock bolts, anchor bolts, and the like), such as those described herein, are used for stabilizing rock excavations, such as mines. In various embodiments, expandable rock anchors may be inserted into a cavity (e.g., a borehole) in a rock structure or other mass and are inflated (e.g., expanded) by introducing an inflation agent (e.g., pressurized gas or fluid) to an interior volume of the rock anchor. FIG. 1A illustrates a cutaway view of several rock anchors 100 in use in an underground mining environment. Each rock anchor 100 is disposed in a cavity 180 (e.g., a borehole, a shaft, a pit, or the like) in a mass 184. The cavity 180 extends from a surface of the mass 184 into the mass. The inflation of the rock anchor 100 causes the exterior surface of the rock anchor to engage with the interior surface of the cavity 180, thereby securing or retaining the rock anchor 100 in the cavity 180. For example, inflation of the rock anchor 100 may cause the exterior surface of the rock anchor to apply a compressive (e.g., outward) force on the interior surface of the cavity 180. Additionally or alternatively, the inflation of the rock anchor may cause a washer 190 disposed around the rock anchor to exert a force on a surface of the mass, thereby structurally stabilizing the mass. In various embodiments, force(s) exerted by the rock anchors 100 contribute to increased structural stability of the mass 184.

The mass 184 may be any substantially solid material or combination of materials, including rock, soil, ice, sand, concrete, and so on. In some embodiments, the surface 182 of the mass 184 is a rock structure, such as a wall or ceiling in a tunnel. The mass 184 may be above or below ground level. In some embodiments, the mass 184 is a wall of a tunnel in an underground mine. The rock anchor 100 may be formed of any suitable material or combination of materials, including metal, polymers, composites, ceramics, and so on. In some embodiments, the rock anchor 100 is formed of steel. The rock anchor 100 may further include various treatments, coatings, and/or linings to improve performance in its application.

In certain applications, the inflation agents that are introduced to the rock anchor 100 are corrosive to the rock anchor. Similarly, while the rock anchor 100 is disposed in the mass 184, it may be exposed to additional corrosive substances, such as groundwater and other corrosive fluids. These corrosive substances may intrude into the interior volume of the rock anchor 100.

In conventional solutions, substantial amounts of inflation agents and other damaging intruded substances may remain in the rock anchors for extended periods of time, and as a result, corrode or otherwise damage the rock anchor. For example, the inflation agent may be water (e.g., groundwater) with corrosive properties that, if left in contact with the rock anchor, leads to corrosion or other damage to the rock anchor. This may affect the structural properties of the rock anchor, such as making it more prone to failure and requiring it to be removed from its application prematurely.

Figure 1B:
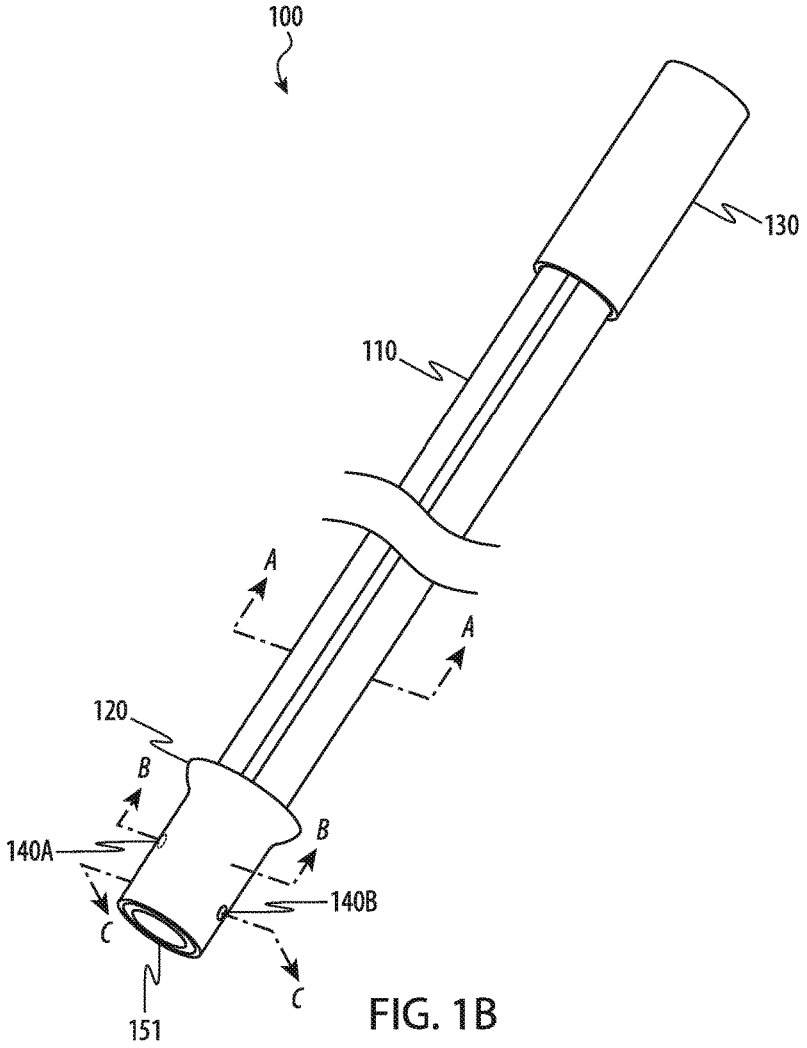
FIG. 1B illustrates an example rock anchor in an unexpanded configuration.
Figure 1C:
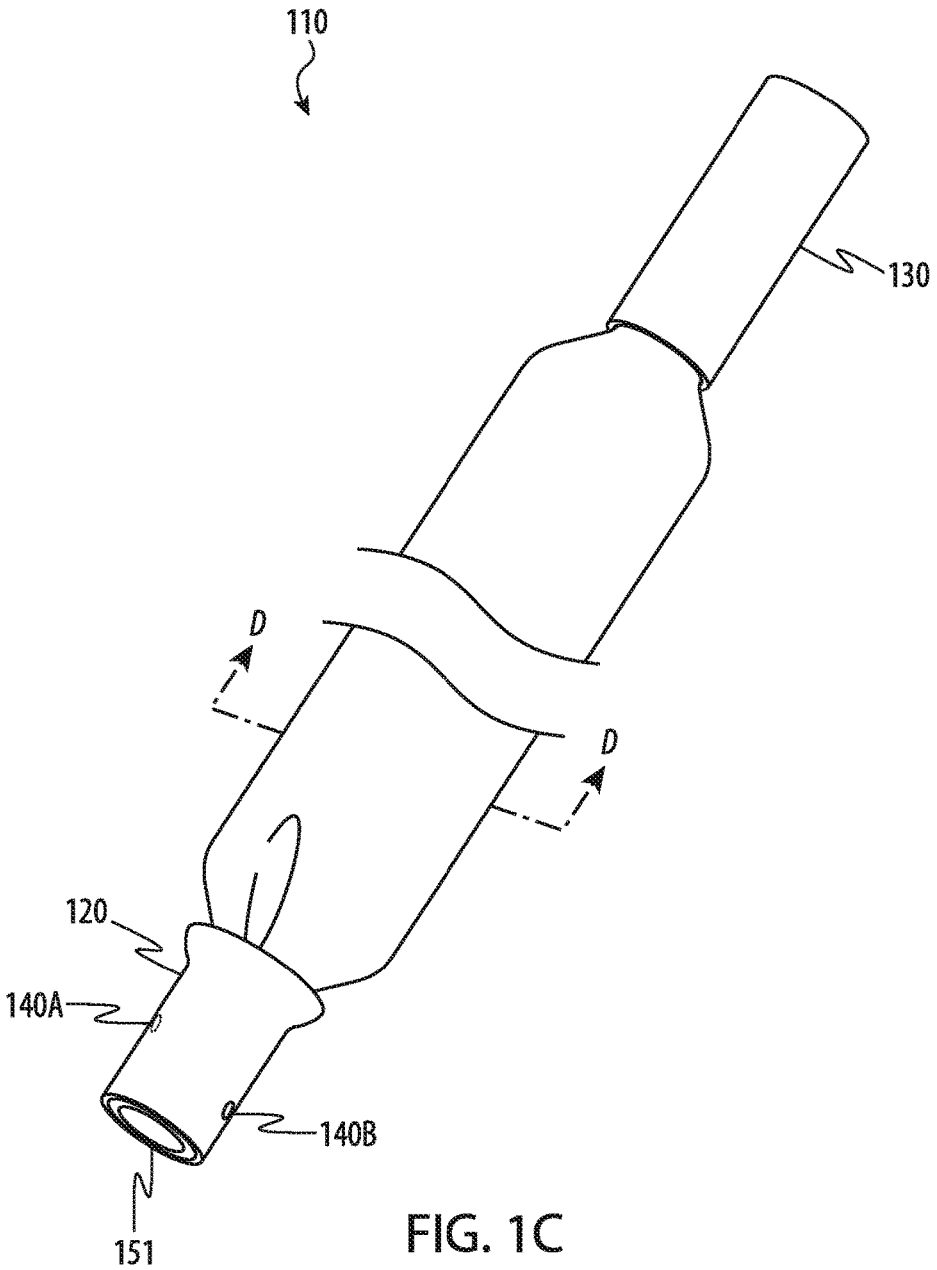
FIG. 1C illustrates the example rock anchor in an expanded configuration.

The rock anchors 100 described herein allow for substantially complete draining of fluids, including inflation agents and intruded substances, from their interior volumes. The rock anchors 100 include multiple passages into the interior volume for more effectively draining fluid from the rock anchors during or after inflation processes and during normal use. FIG. 1B illustrates an example rock anchor 100 in an unexpanded configuration. FIG. 1C illustrates the example rock anchor 100 in an expanded configuration.

Referring to FIG. 1B, the rock anchor 100 includes an anchor body 110, a bushing 120, and an end cap 130. In some embodiments, the anchor body 110 is an elongate member having a first shape (e.g., a "folded tube" shape) in the unexpanded configuration and a different shape (e.g., partially cylindrical) in the expanded configuration, and the bushing 120 and the end cap 130 are disposed at opposite ends of the anchor body 110. The bushing 120 and/or the end cap 130 may be fixedly disposed around a portion of the end of the anchor body 110. The rock anchor 100 defines passages 140A and 140B that extend from the exterior of the rock anchor 100 into one or more interior volumes. In various embodiments, the passages 140A and 140B may be used to introduce an inflation agent into the interior volume(s), thereby causing the anchor body to expand, such as to the expanded configuration of FIG. 1C.

The passages 140A and 140B may also be used to drain inflation agents and/or other fluids from the interior volume(s), such as while the rock anchor 100 is disposed in a cavity 180 as shown in FIG. 1A. In various embodiments, having two or more passages 140 enables substantially all of the inflation agent and/or other fluids to be drained from the interior volume. This may reduce corrosion within the rock anchor 100, and thereby reduces the risk of structural weakening and other disadvantages associated with maintaining fluids in the interior volume.

As shown in FIG. 1B, the rock anchor 100 may include sealed ends (e.g., sealed end 151). In some embodiments, the sealed ends are sealed by welding the anchor body 110 to the bushing 120, for example as shown by sealed end 151 in FIG. 1B. Similarly, a second sealed end of the rock anchor 100 (not shown in FIG. 1B) may be sealed by welding the anchor body 110 to the end cap 130. In various embodiments, the sealed ends may be sealed using a variety of techniques and/or materials, including crimping, welding, plugging, gluing, cementing, melting, and so on. In some embodiments, as a result of the sealed ends, the passages 140 are the only openings to the interior volume(s) of the anchor body.

Figure 2A:
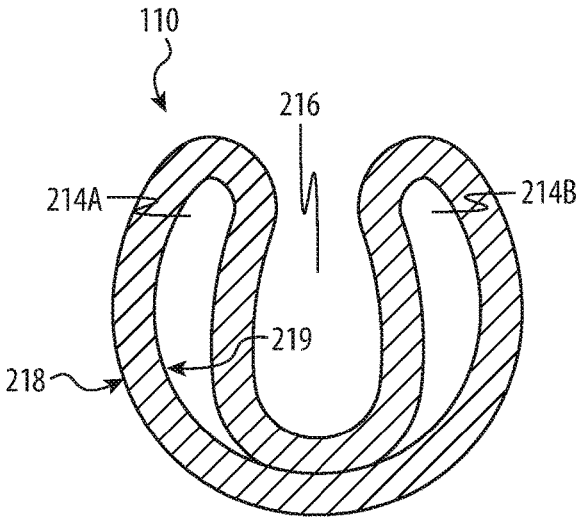
FIG. 2A is a cross-section of an anchor body in an unexpanded configuration, along section line A-A of FIG. 1B.

FIG. 2A is a cross-section of the anchor body 110 in an unexpanded configuration, along section line A-A of FIG. 1B. The anchor body 110 comprises a sidewall 212 that defines an exterior surface 218 and an interior surface 219. In some embodiments, the exterior and interior surfaces are continuous around the entire anchor body 110.

FIG. 2A illustrates the folded tube shape of the anchor body 110. The sidewall 212 forms a crease 216 that separates the inside of the anchor body 110 into two interior volumes 214A and 214B. The folded tube shape may be formed from a tubular member by forming the crease 216 along a side of the tubular member. In another embodiment, the folded tube shape may be formed by extruding the folded tube shape directly. As shown in FIG. 2A, in some embodiments, the interior surface 219 of the sidewall 212 touches the interior surface 219 of the opposing side of the sidewall 212 such that the interior volumes are physically separated and not in fluid communication. In another embodiment, the surfaces of the sidewall 212 do not contact one another, and the interior volume is a single interior volume (e.g., the two interior volumes 214A and 214B are generally distinct from one another but are in fluid communication through a gap between the crease 216).

Figure 2B:
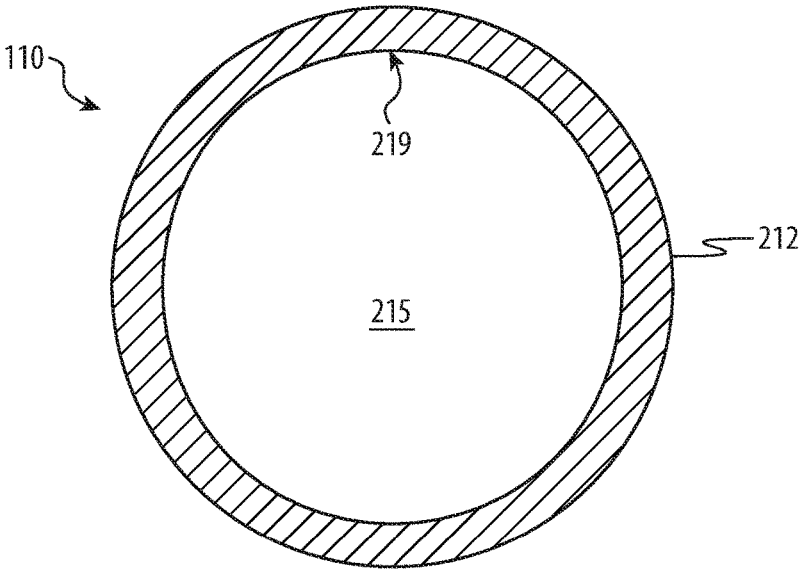
FIG. 2B is a cross-section of an anchor body in an expanded configuration, along section line D-D of FIG. 1C.

FIG. 2B is a cross-section of the anchor body 110 in an expanded configuration, along section line D-D of FIG. 1C. As illustrated in FIG. 2B, the expanded anchor body 110 has a substantially circular cross-section, and a single interior volume 215. As discussed above, the transition from the unexpanded configuration shown in FIG. 2A to the expanded configuration shown in FIG. 2B may be accomplished by the introduction of a pressurized gas or fluid within the interior volume that exerts a sufficient force on the interior surface 219 to expand the anchor body 110 radially outward from with respect to FIGS. 2A and 2B. As shown in FIGS. 2A and 2B, the diameter (e.g., the outer diameter) of the anchor body increases from a first shape having an unexpanded diameter in the unexpanded configuration to a second shape having an expanded diameter in the expanded configuration. In some embodiments, the diameter of the anchor body increases by at least 50%. In another embodiment, the diameter of the anchor body increases between 40% and 60%. In still another embodiment, the diameter of the anchor body increases between 20% and 100%. In various embodiments, the anchor body 110 maintains the second shape even after the inflation agent is removed from the interior volume.

In some embodiments, the cross-sectional area of the single interior volume 215 of FIG. 2B is greater than the combined cross-sectional area of the interior volume(s) 214 of FIG. 2A. As a result, the volume of the interior volume 215 of FIG. 2B is greater than the combined volume of the interior volume(s) 214 of FIG. 2A.

FIG. 2B illustrates a substantially circular cross-section, however, the cross-section of the expanded anchor body 110 may have a different shape depending on various factors, including the shape of the cross-section in the unexpanded configuration, features of the cavity, and the like.

Figure 3:
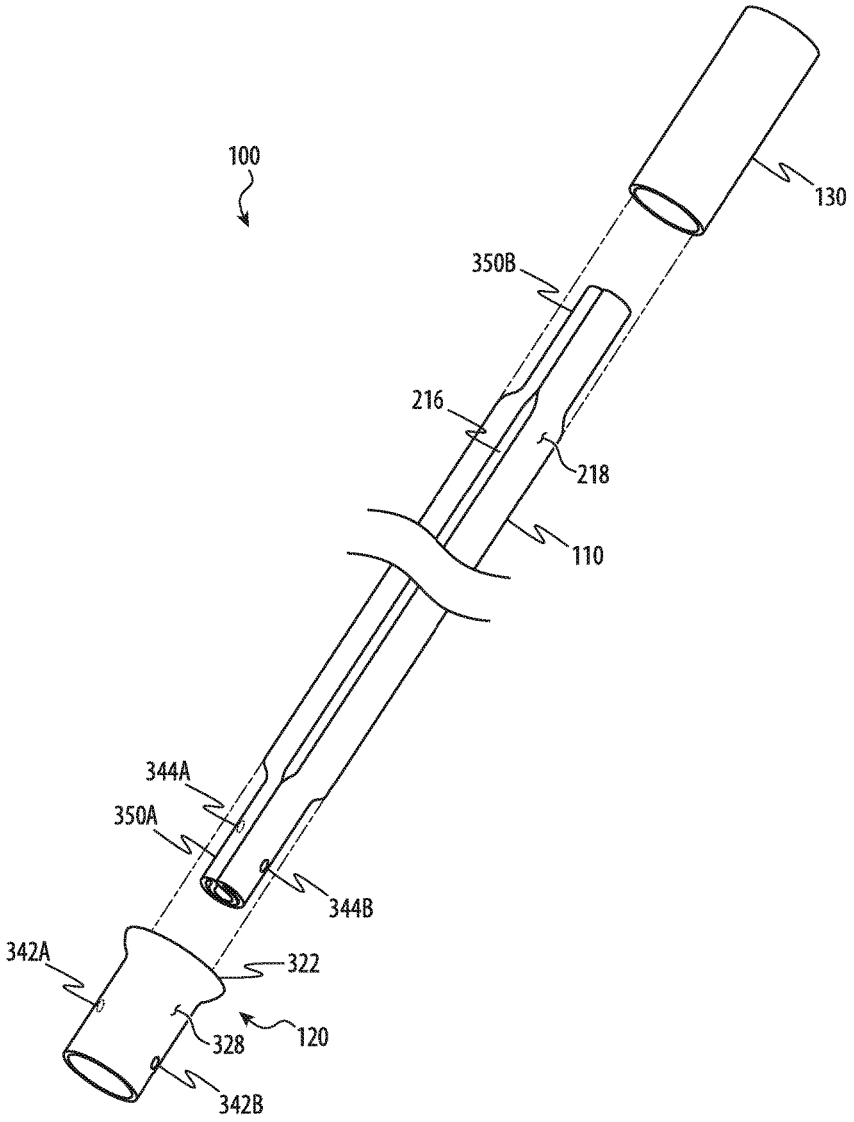
FIG. 3 illustrates an exploded view of a rock anchor in an unexpanded configuration.

FIG. 3 illustrates an exploded view of the rock anchor 100 in an unexpanded configuration. The anchor body 110 defines two or more openings (e.g., openings 344A and 344B) that are formed in the anchor body 110 and extend from the exterior surface 218 of the anchor body, through the sidewall 212 and into the interior volume(s) of the anchor body. The bushing 120 defines two or more openings (e.g., openings 342A and 342B) that are formed in the bushing 120 and extend from an exterior surface 328 of the bushing to an interior surface (not shown) of the bushing. (The exterior surface 328 of the bushing may correspond to a cylindrical surface portion of the bushing.) In some embodiments, when the bushing 120 is secured to the anchor body 110, the openings 344 are aligned with the openings 342, thereby defining the passages 140 of the rock anchor 100 that were discussed above with respect to FIG. 1B. As shown in FIG. 3 and discussed in more detail below with respect to FIGS. 5A-5B, the passages 140 may have a longitudinal offset (e.g., positioned at different distances from the end of the rock anchor 100), as well as a radial offset (e.g., positioned at different radial positions around the circumference of the rock anchor 100).

As shown in FIG. 3, the end portions 350A and 350B of the anchor body 110 may be reduced in diameter compared to the rest of the anchor body 110. In some embodiments, the end portions 350 are crimped or otherwise reduced in diameter. In various embodiments, the reduced diameter of the end portions 350 of the anchor body 110 allows the end portions of to fit inside the bushing 120 and the end cap 130.

In some embodiments, an end of the bushing 120 defines a lip 322. The exterior diameter and/or the interior diameter of the bushing may increase along a portion of the length of the bushing. The lip 322 may be configured to interface with a washer during use of the rock anchor 100, as discussed in more detail below with respect to FIGS. 6A-6B.

In some embodiments, the bushing 120 is between 2 and 2.5 inches in length and between 1 and 1.5 inches in width. In another embodiment, the bushing is 2.31 inches long and 1.19 inches wide. In some embodiments, the rock anchor 100 is between 5 and 15 feet long, but it may be longer or shorter. In another embodiment, the rock anchor is 8 feet long. In some embodiments, the anchor body has a diameter between 0.5 and 3 inches in the unexpanded configuration and between 2 and 5 inches in the expanded configuration. In another embodiment, the anchor body diameter is 1 inch in the unexpanded configuration and 2 inches in the expanded configuration. The dimensions described in this section and elsewhere herein are for example purposes only. In practice, the described elements may be larger or smaller than described. In some embodiments, any value or measurement expressed herein may have a margin of error (e.g., plus-or-minus 5 percent), and need not be exact.

In some embodiments, the end cap 130 and/or the bushing 120 reinforce the sealed ends 151. For example, the end cap 130 and/or the bushing 120 may exert a force on the anchor body 110 that keep the surfaces of the sidewall pressed together, thus maintaining the seal.

Figure 4A:
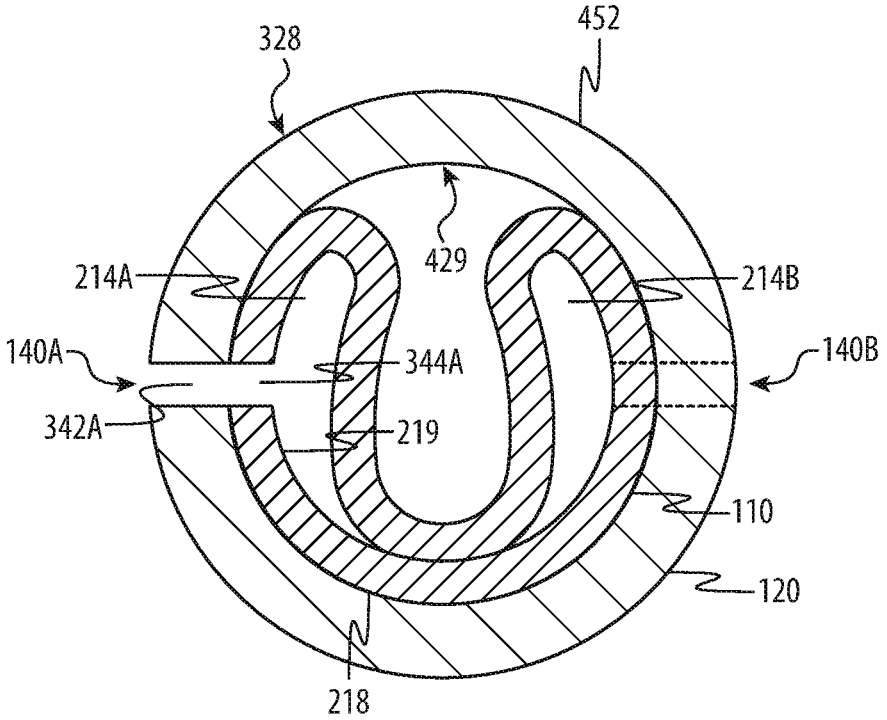
FIG. 4A is a cross-section of a rock anchor having two passages, along section line B-B of FIG. 1B.

FIG. 4A is a cross-section of the rock anchor 100, along section line B-B of FIG. 1B, according to an embodiment. FIG. 4A illustrates the bushing 120 disposed around the anchor body 110. FIG. 4A illustrates the opening 342A and the opening 344A that together form the passage 140A. The passage 140A extends into the interior volume 214A from the exterior surface 328 of the bushing 120 to the interior surface 219 of the anchor body 110. In some embodiments, at least part of the interior surface 429 of the bushing 120 interfaces with at least part of the exterior surface 218 of the anchor body 110.

In some embodiments, such as the embodiment of FIG. 4A, the passage 140A has a radial offset of 180 degrees from the passage 140B (the position of which is shown using dashed lines) with respect to the exterior surface 328 of the bushing 120. In other embodiments, the radial offset between the passages may vary. In still other embodiments, the rock anchor 100 may include three or more passages 140 radially offset by various angles.

Figure 4B:
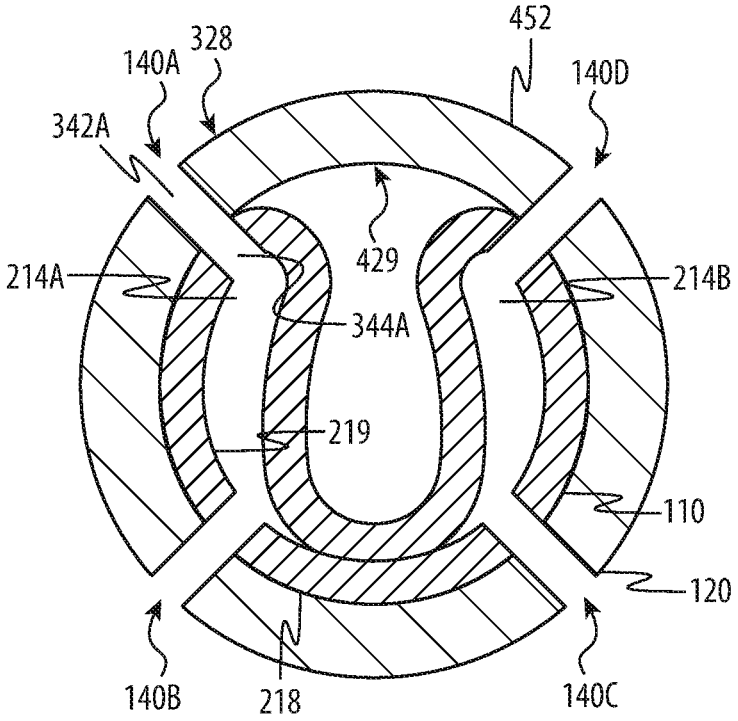
FIG. 4B is a cross-section of a rock anchor having four passages.

FIG. 4B is a cross-section of an embodiment of the rock anchor 100 having four passages 140. In some embodiments, such as the embodiment of FIG. 4B, the passages 140A-D are radially offset from one another around the rock anchor 100 by 90 degrees. In still another embodiment, each of three passages 140 is offset by 120 degrees from the other two. Having two or more passages 140 provides an advantage during use of the rock anchor 100 by allowing substantially all fluid in the interior volume(s) to drain. For example, if the rock anchor 100 is oriented horizontally during use, having four passages 140 may allow at least one passage to be at or near a "bottom" side of the anchor, thereby facilitating draining by gravity.

The openings 344 and openings 342 may have the same shape and size (e.g., cross-sectional area) or may have different shapes and/or sizes from each other. For example, one or more openings 344 may have different shapes and/or sizes from other openings 344, and similarly, one or more openings 342 may have different shapes and/or sizes from other openings 344. Additionally, an opening 344 may have a different shape and/or size than the opening 342 with which it is aligned. The openings 344 and openings 342 may be formed using separate operations (e.g., drilled separately), or they may be formed by a single operation, (e.g., drilling through both the bushing 120 and the anchor body 110). As used herein, a passage may refer collectively to an opening 344 and a corresponding opening 342 that are aligned with one another.

The passages 140 may have a substantially circular cross-section (e.g., substantially cylindrical), or they may be shaped differently (e.g., rectangular, elliptical, irregular, or the like). The passages 140 (and the openings 344 and openings 342) may be formed using a variety of methods, including drilling, cutting, punching, boring, and so on. In some embodiments, the passages 140 are 3/16" diameter holes. In another embodiment, the passages 140 are between 0.1 and 0.3 inches in diameter. In yet another embodiment, the passages 140 are between 0.05 and 0.5 inches in diameter.

Figure 5A:
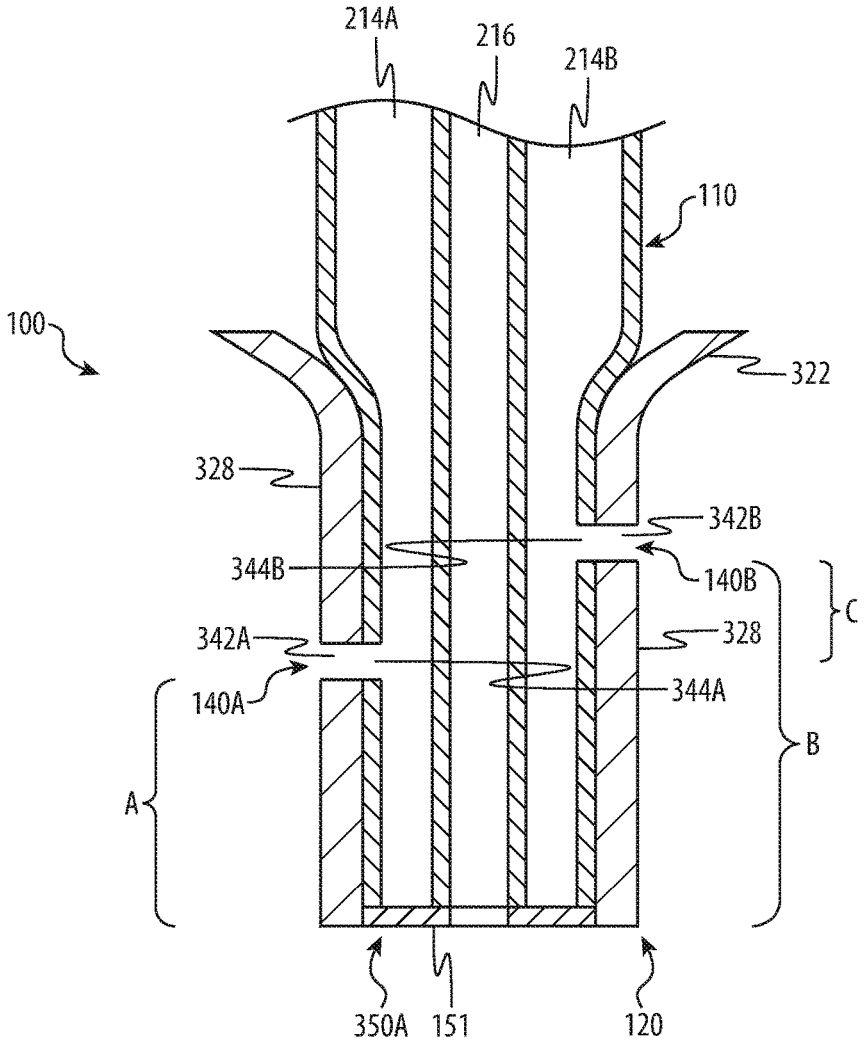
FIG. 5A is a cross-section of a portion of a rock anchor illustrating a longitudinal offset of the passages, along section line C-C of FIG. 1B.

FIG. 5A is a cross-section of a portion of the rock anchor 100 illustrating a longitudinal offset of the passages, along section line C-C of FIG. 1B. In some embodiments, such as the embodiment of FIG. 5A, the passages 140A and 140B have a longitudinal offset C in addition to the radial offset discussed above. The longitudinal offset c is defined by the passages 140 being different distances A and B from the bottom of the rock anchor 100 (with respect to FIG. 5A). In various embodiments, the longitudinal offset of the passages 140 provides better draining performance, including increasing the speed of draining and/or increasing the amount of fluid that may be drained from the rock anchor 100. In some embodiments, substantially all fluid may be drained from the rock anchor 100 using the passages 140. The longitudinal offset may allow air to more easily enter the interior volume during draining. For example, the longitudinal offset may allow air to enter one passage 140 while fluid exits the other passage 140. This helps to equalize the air pressure in the interior volume with the ambient environment more quickly, thereby lessening the vacuum effect of the lower-pressure air in the interior volume. This results in faster and more complete draining of the interior volume of the rock anchor.

In some embodiments, the passages have a longitudinal offset C of between 0.2 and 0.4 inches. In another embodiment, the longitudinal offset C is 0.3125 inches. In some embodiments, the distance from the bottom of the rock anchor 100 to the passage 140A (e.g., distance a in FIG. 5A) is between 0.7 and 0.8 inches. In another embodiment, distance A is 0.75 inches. In some embodiments, the distance from the bottom of the rock anchor 100 to the passage 140B (e.g., distance b in FIG. 5A) is between 1 and 1.1 inches. In another embodiment, distance B is 1.0625 inches.

Figure 5B:
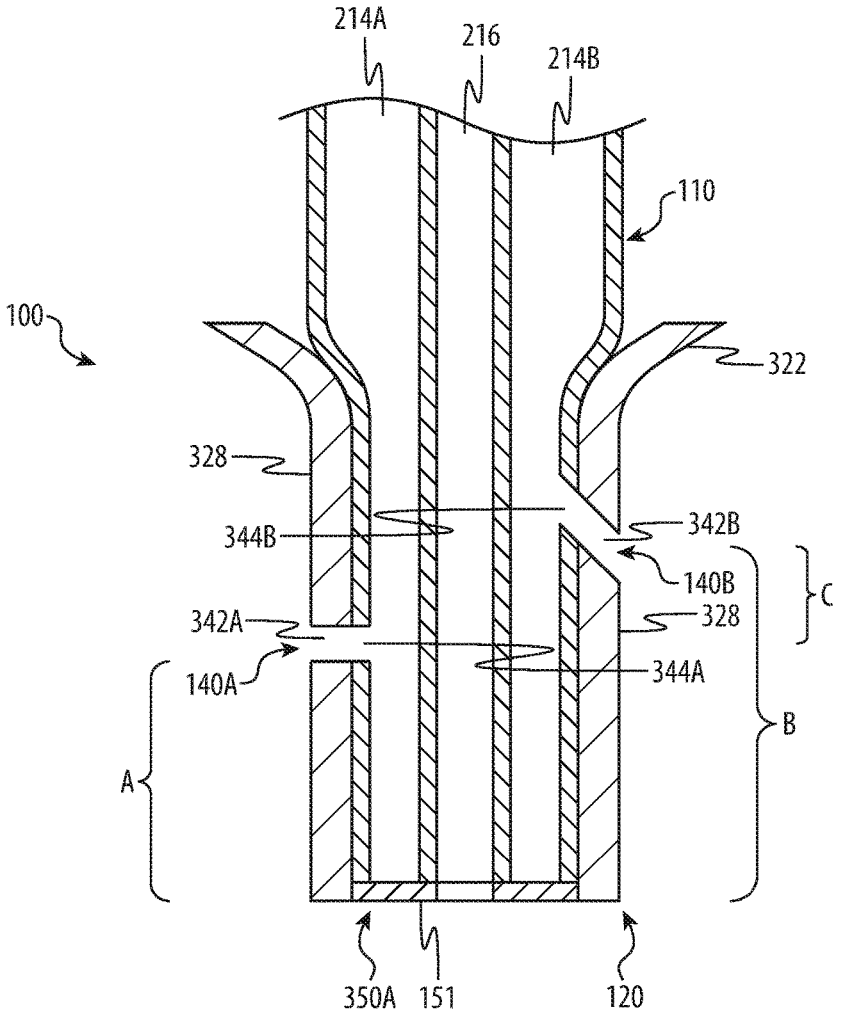
FIG. 5B is a cross-section of a portion of a rock anchor illustrating a non-perpendicular cylindrical axis, along section line C-C of FIG. 1B.

In some embodiments, as shown in FIG. 5A, a cylindrical axis passing through the center of a passage is substantially perpendicular to the exterior surface of the sidewall of the bushing 120 at the location of the passage. In another embodiment, the cylindrical axis is not perpendicular to the exterior surface of the sidewall of the bushing 120 and/or the sidewall of the anchor body 110. FIG. 5B is a cross-section of a portion of the rock anchor 100 illustrating a non-perpendicular cylindrical axis, along section line C-C of FIG. 1B. As shown in FIG. 5B, a cylindrical axis passing through the center of passage 140B is not perpendicular with respect to the sidewall of the bushing 120 and the sidewall of the anchor body 110. In some embodiments, the angle of the cylindrical axis relative to the exterior surface of the bushing 120 is between 10 and 80 degrees. In another embodiment, the angle is substantially equal to 45 degrees. The angle of the cylindrical axis of each passage 140 may differ from or be the same as one or more other passages 140. In various embodiments, non-perpendicular nature of one or more passages 140 provides better draining performance, including increasing the speed of draining and/or increasing the amount of fluid that may be drained from the rock anchor 100. In some embodiments, substantially all fluid may be drained from the rock anchor 100 using the passages 140.

As shown in FIGS. 5A and 5B, the anchor body 110 may be press-fit into the bushing 120. In various embodiments, the press-fit of the anchor body 110 into the bushing 120 forms a seal between the two components such that the passages 140 are sealed. In other embodiments, the anchor body 110 is coupled to the bushing 120 in a variety of ways, including welding, adhesive, and the like. In another embodiment, the bushing 120 and the anchor body 110 may be formed as a single piece.

Figure 6A:
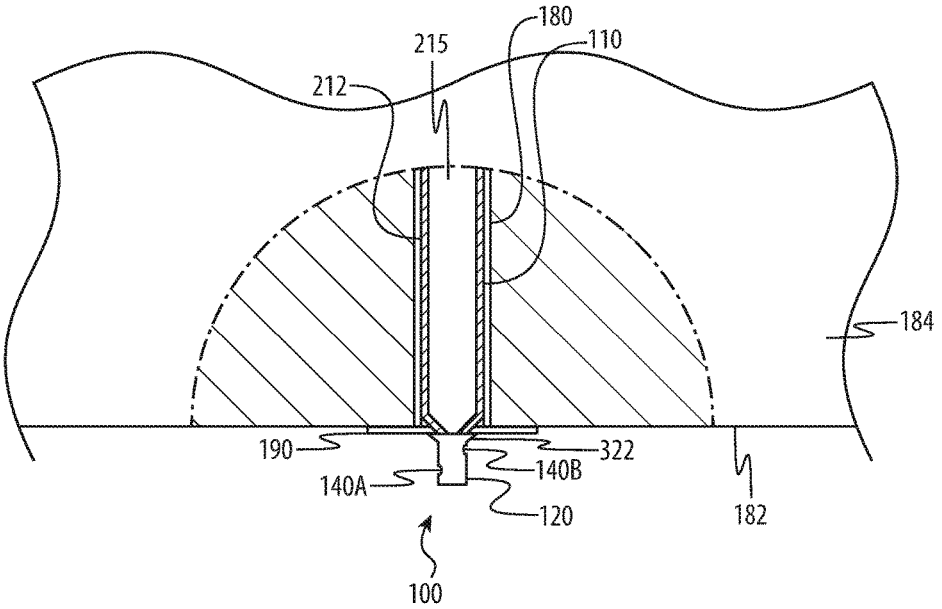
FIG. 6A illustrates a cutaway view of a rock anchor in an expanded configuration and disposed in a borehole in a vertical deployment.
Figure 6B:
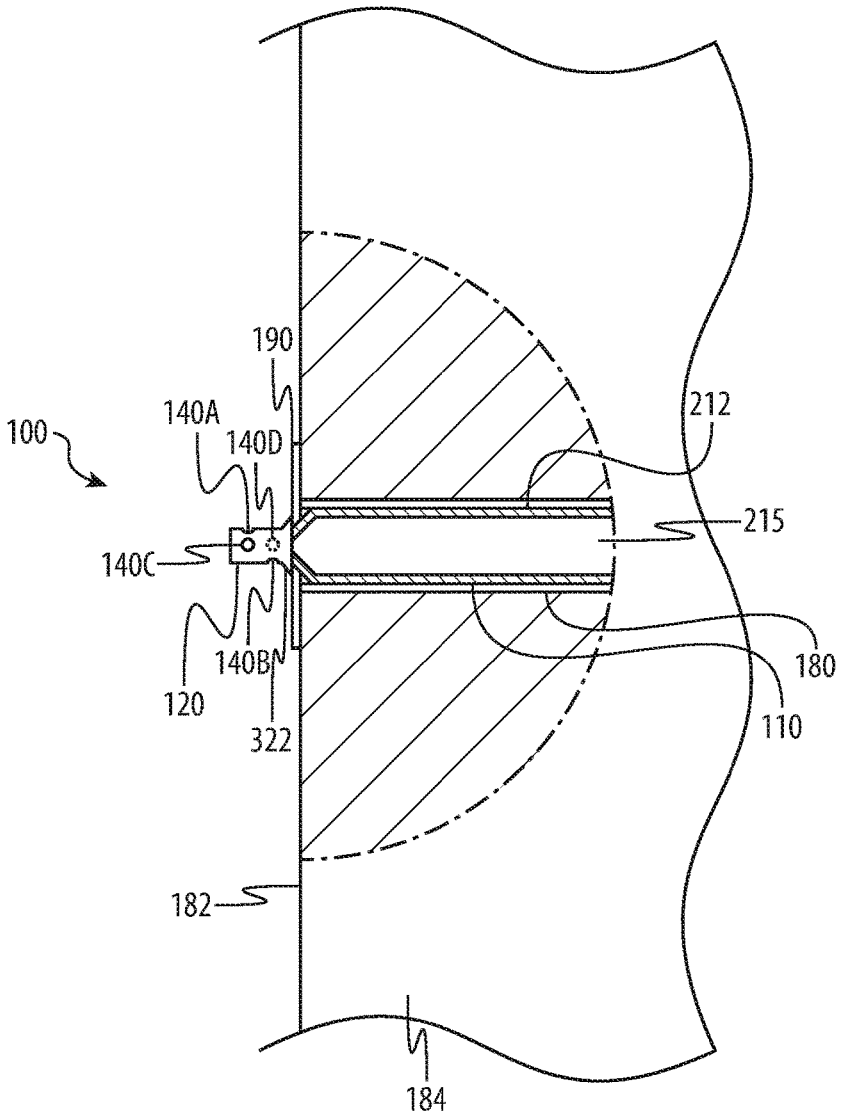
FIG. 6B illustrates a cutaway view of a rock anchor in an expanded configuration and disposed in a borehole in a horizontal deployment.

FIGS. 6A and 6B illustrate a cutaway views of the rock anchor 100 in the expanded configuration and disposed in a cavity 180. In FIG. 6A, the rock anchor 100 is shown in an expanded configuration in a cavity 180 of a mass 184, such as a rock structure. In some embodiments, such as the embodiment shown in FIG. 6A, the rock anchor 100 has been inserted into the cavity 180 in an unexpanded configuration and inflated to the expanded configuration shown, for example by the introduction of fluid (e.g., pressurized fluid) into the interior volume 215. As discussed above, the interior volume 215 may receive an inflation agent via one or more passages140, thereby causing the anchor body of the rock anchor to expand. In the expanded configuration shown in FIG. 6A, the sidewall 212 of the anchor body 110 contacts and engages with the interior surface of the cavity 180. The sidewall 212 exerts an outward force onto the interior surface of the cavity 180, thereby retaining or securing the rock anchor 100 in the cavity 180.

The rock anchor 100 includes a washer 190 disposed around the anchor body 110. The washer 190 is configured to contact a surface 182 of the mass 184 when the rock anchor 100 is in use. The bushing 120 is configured to interface with the washer 190. In some embodiments, the lip 322 of the bushing 120 interfaces with the washer 190 and keeps the washer 190 from sliding off the end of the rock anchor 100. In some embodiments, the bushing 120 exerts a force on the washer 190, and the washer 190, in turn, exerts a corresponding force on the surface 182 (e.g., upward with respect to FIG. 6A), thereby further securing the rock anchor 100 in the cavity 180. In various embodiments, the force(s) exerted by the washer 190 and the rock anchor 100 contribute to increased structural stability of the mass 184.

In some embodiments, the force exerted by the bushing 120 on the washer 190 is caused at least partially by a reduction in the overall length of the rock anchor 100 that occurs during expansion of the rock anchor. For example, the rock anchor 100 may have a first length in the unexpanded configuration and a shorter second length in the expanded configuration. This may result from the expansion of the anchor body of the rock anchor 100. In some embodiments, when the length of the rock anchor 100 is reduced during expansion, it causes the bushing 120 to be drawn toward the cavity 180, which may cause the bushing to exert the force on the washer 190, which in turn exerts the corresponding force on the surface 182 because the washer is disposed between the bushing and the surface.

In some embodiments, the diameter of the cavity 180 is substantially equal to the diameter of the anchor body 110 in the expanded configuration, which is greater than the diameter of the anchor body 110 in the unexpanded configuration. In some embodiments, the diameter of the cavity 180 is between 1 and 5 inches. In another embodiment, the diameter of the cavity is 2 inches.

As shown in FIG. 6A, the passages 140A and 140B have a longitudinal offset which results in the passage 140B being higher than the passage 140A. As discussed above, the longitudinal offset may allow air to more easily enter the interior volume 215 during draining, which results in faster and more complete draining of the interior volume of the rock anchor.

The rock anchor 100 in FIG. 6A is shown disposed in the mass 184 in a vertical deployment. In various embodiments, the rock anchor 100 may be disposed in the hole in a horizontal deployment, or at any angle between vertical and horizontal. FIG. 6B illustrates the rock anchor 100 in a horizontal deployment.

As shown in FIGS. 6A and 6B, a portion of the rock anchor 100 may protrude from the cavity 180. In various embodiments, one or more passages 140 are positioned on the protruding portion. In some embodiments, such as the embodiment of FIG. 6B, the rock anchor 100 includes four passages 140A-D having radial offsets of 90 degrees from one another. As illustrated in FIG. 6B, passages 140C and 140D are substantially level with one another. Without passages 140A and 140B, the position of the passages 140C-D may prevent the interior volume from draining substantially entirely because the passages are not at a lowest point (or otherwise a sufficiently low point) of the bushing 120. However, including passages 140A and 140B allows at least one passage to be at or close to the low point of the bushing 120. For example, in FIG. 6B, passage 140B is at or close to the low point of the bushing 120, which allows for substantially complete draining of the interior volume 215.

As described above, the rock anchor 100, including the anchor body 110, the bushing 120, the end cap 130, and the washer 190 may be formed of any suitable material or combination of materials, including metal, polymers, composites, ceramics, and so on. In some embodiments, the rock anchor 100 is formed of steel. The rock anchor 100 may further include various treatments, coatings, and/or linings to improve performance in its application.

Figure 7A:
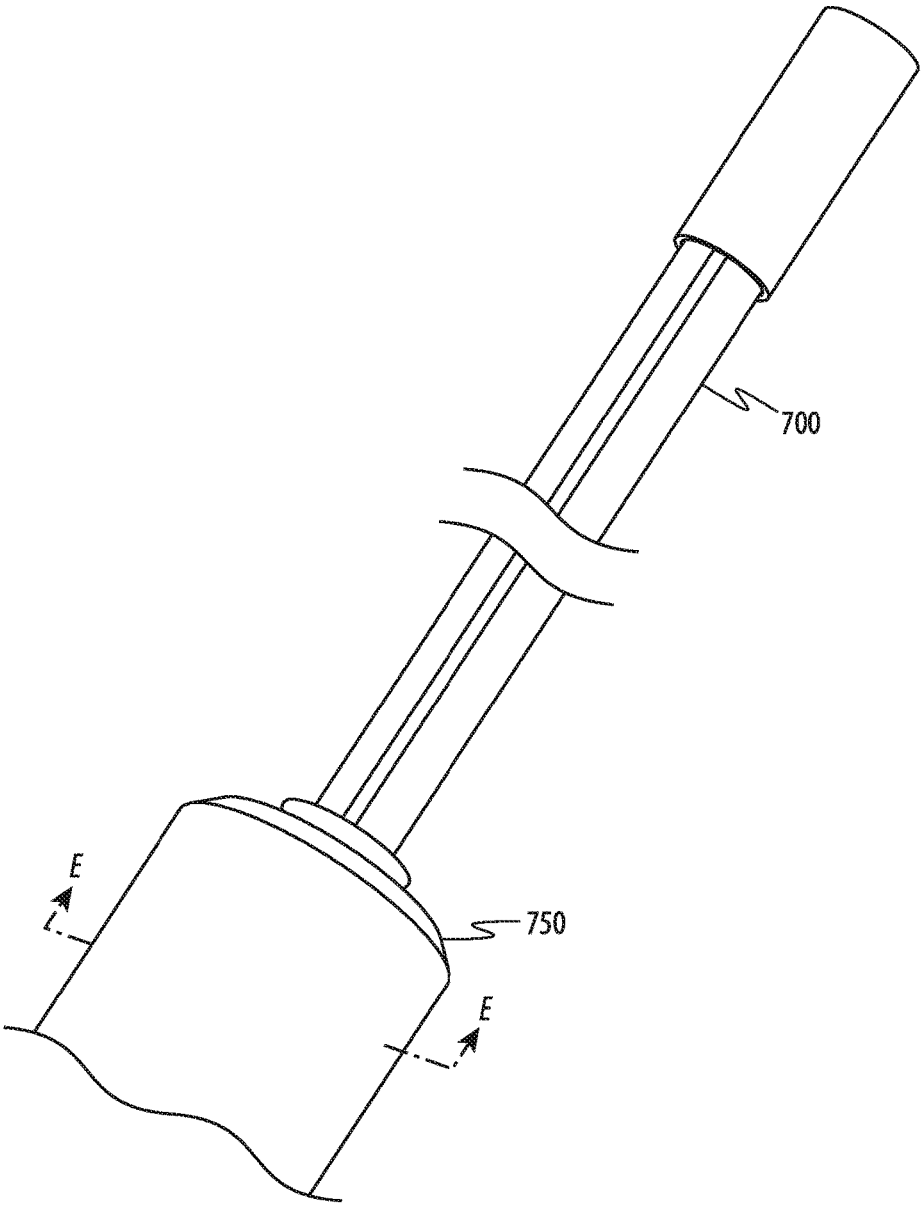
FIG. 7A illustrates a rock anchor disposed in an inflation chuck.

FIG. 7A illustrates a rock anchor 700 disposed in an inflation chuck 750. The rock anchor 700 is similar to the rock anchors discussed herein (e.g., rock anchor 100), and has similar features and components. The inflation chuck 750 is configured to introduce a fluid or gas (e.g., a pressurized fluid) into the rock anchor 700 (e.g., the interior volume) using the passages of the rock anchor 700.

Figure 7B:
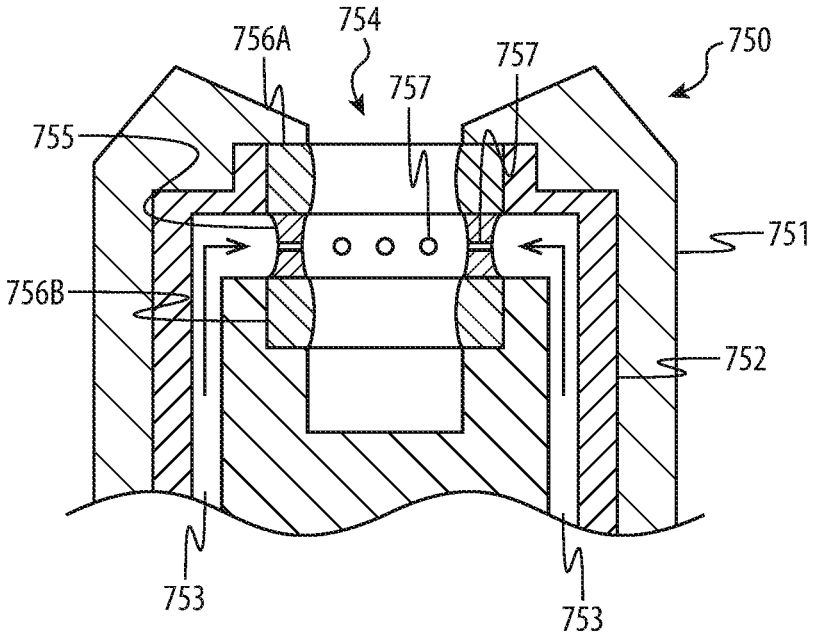
FIG. 7B is a cross-section of an inflation chuck, taken through section line E-E of FIG. 7A.

FIG. 7B is a cross-section of the inflation chuck 750 without the rock anchor 700, taken through section line E-E of FIG. 7A. The inflation chuck 750 includes a housing 751 that is disposed around an inner housing 752. The housing 751 and the inner housing 752 define an opening 754 that is configured to receive a portion of a rock anchor, such as a bushing. The inflation chuck further includes an inflation ring 755. The inflation ring 755 defines one or more openings 757 that fluidly couple the opening 754 to one or more inflation channels 753. The inflation chuck 750 further includes an upper gasket 756A and a lower gasket 756B. The gaskets 756 are configured to form a seal (e.g., a watertight seal, an airtight seal, etc.) around the inflation ring 755.

Figure 7C:
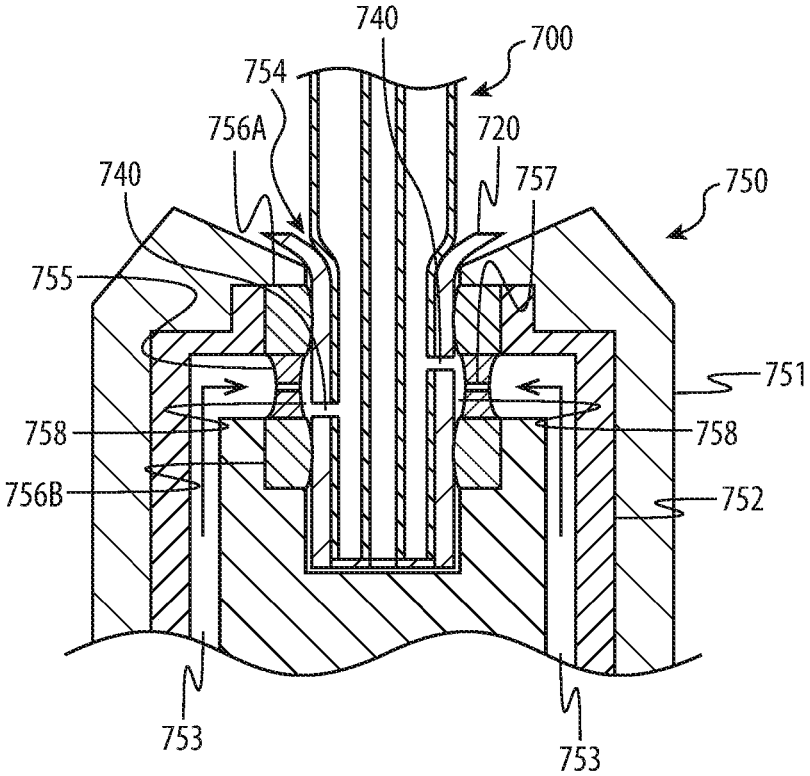
FIG. 7C is a cross-section of the inflation chuck and a portion of a rock anchor, taken through section line E-E of FIG. 7A.

FIG. 7C is a cross-section of the inflation chuck 750 and a portion of the rock anchor 700, taken through section line E-E of FIG. 7A. In an inflation configuration (e.g., during an inflation process), the bushing 720 is at least partially disposed within the opening 754 of the inflation chuck 750. The inflation ring 755 at least partially encircles the bushing 720 when the bushing 720 is disposed within the opening 754. At least one passage 740 of the rock anchor aligns (e.g., aligns vertically with respect to FIG. 7C) with the inflation ring 755 such that the inflation channels 753 are fluidly coupled to the interior volume of the rock anchor 700. The inflation chuck 750 introduces an inflation agent into the interior volume of the rock anchor 700 via the inflation ring 755 and the passage(s) 740. The gaskets 756 compress against the bushing 720 to form a seal around the inflation ring 755 and create a void 758 within the inflation ring 755 and around the rock anchor 700. The inflation channels 753 carry an inflation agent (e.g., pressurized fluid or gas) from an inflation device (e.g., a pump, a tank, compressor, or the like), through the openings 757 and into the void 758. The fluid or gas in the void flows into the rock anchor 700 via the one or more passages 740 that are aligned with the inflation ring. The inflation agent is received in the interior volume, thereby causing expansion of the rock anchor.

After inflation, the inflation chuck 750 is removed from the rock anchor 700 and the rock anchor 700 is in a draining configuration. In some embodiments, in the draining configuration, the passages 740 couple the interior volume of the rock anchor 700 to the ambient environment, and the fluid or gas drains from the interior volume via the passages 740. In some embodiments, the draining occurs as a result of pressure release and/or gravity. As discussed above, in various embodiments, substantially all of the fluid or gas is drained from the rock anchor 700.

Figure 8:
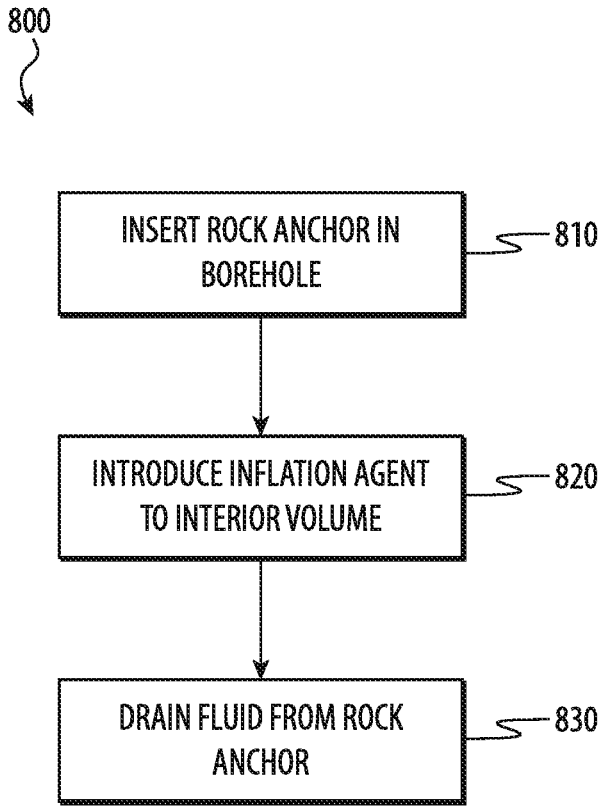
FIG. 8 is a simplified flow chart depicting an example process for inflating and draining a rock anchor.

FIG. 8 is a simplified flow chart depicting an example process 800 for inflating and draining a rock anchor. At step 810, the rock anchor is at least partially inserted in a cavity, such as a borehole in a rock structure, in an unexpanded configuration, in which the rock anchor has a first shape, such as a "folded tube" shape. In the unexpanded configuration, the rock anchor may have a diameter that is less than the diameter of the cavity. At step 820, an inflation agent is introduced to the interior volume of the rock anchor. In some embodiments, introducing the inflation agent includes coupling the interior volume to an inflation device via at least one passage in the rock anchor. The interior volume may be substantially filled with the inflation agent, thereby causing the rock anchor to expand (e.g., inflate) to an expanded configuration, in which the rock anchor has a second expanded shape. In the expanded configuration, the diameter of the rock anchor may be substantially the same as the diameter of the cavity such that the rock anchor is secured in the cavity.

At step 830, substantially all of the inflation agent is drained from the rock anchor. In various embodiments, fluid, including the inflation agent, is drained from the rock anchor using at least two passages in the rock anchor. In some embodiments, removing the inflation device from the rock anchor, for example in response to the rock anchor reaching the second configuration having the second shape, fluidly couples the interior volume to the ambient environment via the passages. In some embodiments, fluid flows out of the interior volume of the rock anchor via at least one passage and air flows into the interior volume of the rock anchor via at least one passage. This enables more fluid to be drained from the interior volume than conventional techniques, which may leave substantial amounts of fluid in the interior volume. In some embodiments, during the use of the rock anchor (e.g., while it is disposed in a borehole), groundwater or other fluid may be introduced into the interior volume. The passages allow this fluid to be drained from the rock anchor throughout the use of the inflation anchor. In various embodiments, the rock anchor maintains the second expanded shape after the inflation agent has been drained from the rock anchor.

In some embodiments, draining is facilitated by fluidly coupling the interior volume to an ambient environment (e.g., by decoupling an inflation chuck). This allows free flow of fluid and air. In various embodiments, draining is assisted by gravity pulling fluid downward toward a passage. In other embodiments, a draining device may be used to remove the inflation agent or other fluids from the rock anchor. For example, in some embodiments, a low pressure may be induced at one or more passages, for example using a vacuum device, to draw out fluid. Additionally or alternatively, pressurized gas, such as air, may be introduced into a passage, thereby causing fluid to exit one or more passages. In the above examples, one or more passages may have to be vented to the ambient environment. In some embodiments, draining is a substantially isothermal process.

As noted above, many embodiments described herein reference a modular button assembly for a portable electronic device. It may be appreciated, however, that this is merely one example; other configurations, implementations, and constructions are contemplated in view of the various principles and methods of operations—and reasonable alternatives thereto—described in reference to the embodiments described above.

One may appreciate that although many embodiments are disclosed above, that the operations and steps presented with respect to methods and techniques described herein are meant as exemplary and accordingly are not exhaustive. One may further appreciate that alternate step order or fewer or additional operations may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. A self-draining rock anchor comprising:

an elongate anchor body configured to be at least partially disposed in a cavity that extends from a surface of a rock structure into the rock structure, the elongate anchor body comprising a sidewall that extends along a length of the elongate anchor body, the sidewall defining:

a first opening that extends through the sidewall; and a second opening that extends through the sidewall; and a bushing disposed around the elongate anchor body and configured to interface with a washer disposed around the elongate anchor body, the bushing defining:

a third opening that substantially aligns with the first opening in the elongate anchor body, the first and third openings forming a first passage into an interior volume of the elongate anchor body; and a fourth opening that substantially aligns with the second opening in the elongate anchor body, the second and fourth openings forming a second passage into the interior volume of the elongate anchor body; wherein:

the first passage is positioned a first distance from an end of the bushing;

the second passage is positioned a second distance from the end of the bushing, the second distance different than the first distance;

the elongate anchor body has a first diameter in a first configuration;

the interior volume of the elongate anchor body is configured to receive an inflation agent via at the least one of the first or second passages, thereby causing the elongate anchor body to expand to a second expanded configuration in which the elongate anchor body has a second diameter greater than the first diameter; and in the second expanded configuration:

an exterior surface of the sidewall of the elongate anchor body is configured to engage with an interior surface of the cavity, thereby retaining the elongate anchor body in the cavity;

the bushing is configured to exert a force on the washer, thereby causing the washer to exert a corresponding force on the surface of the rock structure; and the first and second passages facilitate substantially complete draining of the interior volume.

2. The self-draining rock anchor of claim 1, wherein:

in the second expanded configuration:

the first and second passages substantially completely drain the inflation agent from the interior volume;

the elongate anchor body has an expanded shape; and the elongate anchor body maintains the expanded shape after the inflation agent is drained from the interior volume.

3. The self-draining rock anchor of claim 1, wherein:

in the first configuration, the self-draining rock anchor has a first length;

in the second configuration, the self-draining rock anchor has a second length shorter than the first length; and the force exerted by the bushing on the washer is at least partially caused by a reduction from the first length to the second length during a transition from the first configuration to the second configuration.

4. The self-draining rock anchor of claim 1, wherein:

the inflation agent is a pressurized fluid;

during a transition from the first configuration to the second configuration, at least one of the first or second passages fluidly couples the interior volume to an inflation device configured to introduce the pressurized fluid into the interior volume; and after the transition from the first configuration to the second configuration, the first and second passages facilitate substantially complete draining of the pressurized fluid from the interior volume.

5. The self-draining rock anchor of claim 1, wherein in the second configuration, the first and second passages fluidly couple the interior volume to an ambient environment to drain at least one of the inflation agent or an intruded substance from the interior volume.

6. The self-draining rock anchor of claim 1, wherein: the cavity is a borehole;

the first diameter is less than a diameter of the borehole; and the second diameter is substantially equal to the diameter of the borehole.

7. The self-draining rock anchor of claim 1, wherein:

the washer is disposed between the bushing and the surface of the mass; and the bushing defines a lip configured to interface with the washer.

8. The self-draining rock anchor of claim 1, wherein:

a portion of the self-draining rock anchor protrudes from the cavity; and the first and second passages are positioned in the protruding portion.

9. A rock anchor comprising:

an anchor body defining an interior volume and comprising a first scaled end and a second scaled end; and a bushing fixedly disposed around a portion of the anchor body and defining an exterior surface, the bushing configured to be disposed at least partially within an inflation device in an inflation configuration, the inflation device defining an opening and comprising an inflation ring that is configured to encircle the bushing in the inflation configuration, wherein:

the anchor body and the bushing define:

a first substantially cylindrical passage positioned a first distance from an end of the bushing and extending from the exterior surface of the bushing into the interior volume of the anchor body; and a second substantially cylindrical passage positioned a second distance different than the first distance from the end of the bushing and extending from the exterior surface of the bushing into the interior volume of the anchor body;

in the inflation configuration:

at least one of the first or second substantially cylindrical passages is configured to align with the inflation ring; and the interior volume of the anchor body is configured to receive an inflation agent from the inflation ring via the at least one of the first or second substantially cylindrical passages, thereby causing the anchor body to expand from a first shape having a first diameter to a second shape having a second diameter greater than the first diameter; and in a draining configuration:

the first and second substantially cylindrical passages fluidly couple the interior volume to an ambient environment to drain substantially all fluid from the interior volume via the first and second passages; and the anchor body maintains the second shape.

10. The rock anchor of claim 9, wherein:

the first distance is between 0.7 and 0.8 inches; and the second distance is between 0.9 and 1.1 inches.

11. The rock anchor of claim 9, wherein:

at least a portion of the rock anchor is configured to be disposed in a borehole; and the second diameter is substantially equal to a diameter of the borehole.

12. The rock anchor of claim 9, wherein the first and second sealed ends are crimped; and the bushing is disposed at one of the first or second sealed ends.

13. The rock anchor of claim 9, wherein the first substantially cylindrical passage has a diameter between 0.1 and 0.2 inches.

14. The rock anchor of claim 9, wherein a cylindrical axis of at least one of the first or second substantially cylindrical passages is not perpendicular to the exterior surface of the bushing.

15. The rock anchor of claim 9, wherein a cylindrical axis of at least one of the first or second substantially cylindrical passages is substantially perpendicular to the exterior surface of the bushing.

16. A method for expanding and draining an expandable rock anchor comprising:

inserting, at least partially into a borehole, a rock anchor having a first shape having a first diameter that is less than a diameter of the borehole, the rock anchor defining:

a first opening to an interior volume of the rock anchor, the first opening positioned a first distance from an end of the rock anchor; and a second opening to an interior volume of the rock anchor, the second opening positioned a second distance different than the first distance from an end of the rock anchor;

substantially filling the interior volume with fluid using at least one of the first or second openings, thereby causing the rock anchor to expand to a second shape having a second diameter that is greater than the first diameter and substantially equal to the diameter of the borehole; and draining substantially all of the fluid from the interior volume using the first and second openings, wherein:

the rock anchor maintains the second shape following the draining of substantially all of the fluid from the interior volume; and an exterior surface of the expanded rock anchor engages with an interior surface of the borehole, thereby retaining the rock anchor in the borehole.

17. The method of claim 16, wherein draining substantially all of the fluid from the interior volume comprises:

causing the fluid to flow out of the interior volume through at least one of the first or second openings; and causing air to flow into the interior volume through at least one of the first or second openings.

18. The method of claim 16, wherein:

substantially filling the interior volume with fluid comprises fluidly coupling the interior volume to an inflation device via at least one of the first or second openings;

the method further comprises removing the inflation device in response to the rock anchor having the second shape; and removing the inflation device fluidly couples the interior volume with an ambient environment via the first and second openings.

* * * * *